United States Patent [19]

Couleau et al.

[11] Patent Number: 4,609,570

[45] Date of Patent: Sep. 2, 1986

[54] RELEASE COMPOSITION FOR HYDRAULIC BONDING MATERIALS, METHOD FOR FACILITATING UNMOLDING OF HYDRAULIC BONDING MATERIALS FROM MOLDS, AND METHOD FOR CASTING MOLDED PRE-FORMED ARTICLES OF HYDRAULIC BONDING MATERIALS

[75] Inventors: Robert Couleau, Parsac; Jean P. Guicquero, Labarte sur Leze, both of France

[73] Assignee: Societe Anonyme Chryso, Mazarin, France

[21] Appl. No.: 479,030

[22] Filed: Mar. 25, 1983

[30] Foreign Application Priority Data

Mar. 25, 1982 [FR] France ..... 82 05481

[51] Int. Cl.[4] ..... B44D 1/20; B28B 7/36

[52] U.S. Cl. ..... 427/135; 106/38.22; 106/38.24; 264/213; 264/333; 264/338; 427/133

[58] Field of Search ..... 264/333, 39, 213, 300, 264/338; 106/38.22, 38.24; 210/749, 757; 427/133, 135

[56] References Cited

U.S. PATENT DOCUMENTS

| | | | |
|---|---|---|---|
| 1,558,440 | 10/1925 | Weber | 106/38.24 |
| 1,967,830 | 7/1934 | Lemmerman | 427/133 |
| 2,784,108 | 3/1957 | Cupper | 106/38.24 |
| 2,901,361 | 8/1959 | Meisel, Jr. | 106/38.24 |
| 2,932,576 | 4/1960 | Vierk et al. | 106/38.22 |
| 4,003,867 | 1/1977 | Cooper et al. | 106/38.22 |

FOREIGN PATENT DOCUMENTS

| | | | |
|---|---|---|---|
| 851521 | 6/1977 | Belgium . | |
| 0531440 | 10/1956 | Canada | 106/38.24 |
| 1962444 | 9/1971 | Fed. Rep. of Germany . | |
| 2125381 | 12/1971 | Fed. Rep. of Germany . | |
| 2328761 | 5/1977 | France . | |
| 2487848 | 2/1982 | France . | |

OTHER PUBLICATIONS

Hawley, "The Condensed Chemical Dictionary", 10th ed., Van Nostrand Reinhold, NY 1981 pp. 430 & 730.

Chemical Abstracts, vol. 89, p. 292, No. 184740h, 1978.

Chemical Abstracts, vol. 91, 8807t, 1979.

*Primary Examiner*—Jan Silbaugh

*Assistant Examiner*—Hubert C. Lorin

*Attorney, Agent, or Firm*—Sandler & Greenblum

[57] ABSTRACT

A release composition which facilitates the unmolding of bonding materials such as concretes from molds for purposes of pre-fabrication. Methods for facilitating the unmolding of such bonding materials by coating the mold with such release composition, and for casting molded, preformed articles include coating the mold prior to casting in order to facilitate the unmolding operations. The release composition is an aqueous anti-freeze solution containing no petroleum based products. It comprises a combination of at least one active release constituent which may be an organic acid salt, at least one clarifying anti-freeze agent which may be a hydroxyethylether; at least one spreading agent which is an ester; at least one polyether lubricating agent; and water as a solvent medium, in variable proportion according to the desired concentration.

42 Claims, No Drawings

RELEASE COMPOSITION FOR HYDRAULIC BONDING MATERIALS, METHOD FOR FACILITATING UNMOLDING OF HYDRAULIC BONDING MATERIALS FROM MOLDS, AND METHOD FOR CASTING MOLDED PRE-FORMED ARTICLES OF HYDRAULIC BONDING MATERIALS

BACKGROUND OF THE INVENTION

1. Field of the Invention

The present invention relates to a release composition for hydraulic bonding materials such as, e.g., concrete, and to methods for using such release composition to facilitate unmolding operations and for casting molded pre-formed articles.

2. Description of Prior Art

It is known in the art of molding concrete pieces to coat those mold surfaces which come into contact with the material being molded with a product which facilitates the unmolding and which attains a satisfactory surface condition for the pieces. The release compositions presently used are constituted essentially, according to various formulas, of a mixture of organic solvents and petroleum products to which are added active release ingredients.

Emulsions which include a percentage of petroleum products and which are stable to a greater or lesser degree over time have also been proposed. The use of petroleum products tends to inflate the cost of these release compositions. Moreover, the presence of these solvent/petroleum oil mixtures necessitates a drying period for the unmolded surfaces before any other treatment, such as painting, can be effected, since paint would not adhere to a wet treated surface.

SUMMARY OF THE INVENTION

Objects of the present invention include the elimination of the above-mentioned inconveniences by providing a release composition containing no petroleum products, and providing improved methods for facilitating the unmolding of molded articles and for casting molded, pre-formed articles from hydraulic bonding material.

To achieve these objects, the release compositions according to the invention consist of a combination of at least one active release constituent, which is an organic acid salt; at least one clarifying anti-freeze agent, which is a hydroxyethyl ether; at least one spreading agent, which may be an ester; at least one lubricating agent consisting of a water-soluble polymer; and a solvent medium, which is preferably water. The proportions of the above constituents, especially those of the solvent medium, can be varied according to the desired concentration of the end products, which are clear, aqueous solutions resistant to freezing and stable over time.

A further aspect of the invention is a novel method for facilitating the unmolding of hydraulic materials from molds by coating the molds with the release composition of the invention and drying the composition prior to casting the hydraulic materials in the mold. Yet another aspect is an improved method of casting hydraulic bonding materials such as concrete comprising the pretreatment of the molds with the release composition of the invention and, after it dries, casting the bonding material in the mold, allowing it to set, and unmolding it.

DESCRIPTION OF PREFERRED EMBODIMENTS

The following is a description of a preferred embodiment of the release composition. It should be understood that the proportions and the percentages set forth are merely illustrative and do not limit the range of compositions within the scope of the invention.

The water-based release compositions according to the invention are composed of the combination of an active release agent, which facilitates the removal of the manufactured pieces from the walls of the mold; a clarifying anti-freeze agent which solubilizes the active release agent and which can be varied in concentration to insure against freezing at ambient temperatures; a spreading agent which permits the formation of a uniform film on the walls of the mold after application and during the drying operation; a lubricating agent which cooperates with the spreading agent to assure a certain film thickness and its continuity; and water as a solvent medium.

The active release agent is an organic acid salt, the cationic part of which may be, e.g., sodium+, potassium+, ammonium+, cationic amines and their derivatives. Ammonium salts are preferred because of their solubility and the absence of undesirable effects on the action of the release composition, such as delay in the setting of the bonding material or the possibility that the bonding material might turn into a powder rather than set. Moreover, ammonium salts have the advantage of releasing ammonia gas during saponification by calcium ion present in the water solvent medium, in that the ammonia gas helps in the unmolding process.

The anionic part of the organic acid salt is comprised of one or more carboxylic acids containing no more than one hydroxyl function per molecule. Preferably, these acids will be saturated or unsaturated linear, cyclic or branched chain hydrocarbons, having at least five, and preferably ten to thirty, carbon atoms. Suitable acid include hexanoic, decanoic, cyclohexyl carboxylic, naphthenic, neodecanoic, abietic, dodecanoic, myristic, caprylic, oleic, palmitic, pelargonic, undecylic, Versatic and cyclohexadienic.

The preferred clarifying anti-freeze agents are hydroxyethyl ether and ethers of the general formula $R(OCH_2CH_2)_nOH$, where R is a branched or linear aliphatic chain comprising from one to six carbon atoms, and n is a number between one and three. For example:

R=hexyl, n=2: hexyl-diethylene glycol

R=ethyl, n=3: ethyl-triethylene glycol

The water soluble spreading agent can be chosen from among the ethoxyl fatty alcohols, or low molecular weight derivatives of cellulose, such as hydroxyethyl, methoxy, or carboxymethyl ethers.

The spreading agent can also be chosen from among the hydroxyl and/or ethoxyl esters.

This choice should be with the purpose of minimizing delaying effects on the setting of the bonding material. Tests have shown that ethers produce better results. Esters which may be used as spreading agents are derived from polyols, e.g., glycerin, trimethylolpropane, pentaerythritol, etc., which are partially esterfied by a mono- or di-basic organic fatty acid. Free hydroxl functions of the polyol will be ethoxylated so as to insure a limited water solubility of the product.

The general formula for the polyols to be used is R(OH)n, where R is an alkyl group having from 2 to 6 carbon atoms. For the ethoxylated esters, the general formula is

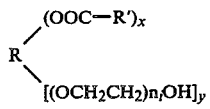

where R' is the residue of a fatty acid having from 8 to 22 carbon atoms; $n_i$ represents the degree of ethoxylation of free hydroxyl functions; and x+y=n of polyol R(OH)n.

The lubricating agent is comprised of water soluble polymers, which can be cellulosic derivatives such as hydroxyethylethers, methoxyethers, or carboxyethers. The lubricating agent can also be a linear polysaccharide or a polyglycol of very high molecular weight. The criteria for choosing the product are: which causes the minimum delay in the setting of the hydraulic bonding material, and which provides the best lubrication. In order to give the release composition a viscosity between one and two degrees of the Engler scale, it is preferable to use a polyglycol with a very long chain. Tests of such compounds have shown very good results.

Water has been selected as the solvent medium because of its low cost. If the water has too great a degree of hardness due to the presence of calcium, this can be masked by adding a sequestering agent such as ethylenediaminetetracetic acid (EDTA) or nitrilotriacetic acid, or the like. The amount of the sequestering agent added should be sufficient to mask the calcium so as to assure that it does not modify the final properties of the release composition. The absence of sequestering agents in hard water may necessitate an increase in the amount of clarifying agent, while an excess of such agents can lead to a delay in the setting of the bonding material.

The proportions of the components of a preferred release composition in accordance with the invention can be summarized according to the following formula:

1-Organic acid(s): 2 to 10 grams for 100 $cm^3$
Ammonium hydroxide: 0.01 to 0.02 mole for 100 $cm^3$
2-Hydroxyethyl ether: 5 to 10 grams for 100 $cm^3$
3-Hydroxy-functional ester: 0.2 to 1 gram for 100 $cm^3$
4-Polyglycol: 0.1 to 0.2 gram for 100 $cm^3$
5-Water: Sufficient amount to make 100 $cm^3$ To avoid transporting water, the release composition can be made in the form of a dilutable concentrate so that two liters of water would be added to one liter of concentrate to produce three liters of product which is ready to be used.

The composition of the concentrate can be as follows:

1-Organic acid(s): 8 to 25 grams for 100 $cm^3$
Ammonium hydroxide: 0.03 to 0.06 mole for 100 $cm^3$
2-Hydroxyethyl ether: 8 to 25 grams for 100 $cm^3$
3-Hydroxy-functional ester: 0.6 to 3 grams for 100 $cm^3$
4-Polyglycol: 0.3 to 0.6 gram for 100 $cm^3$
5-Water: Sufficient amount to make 100 $cm^3$

Practical Example 50 grams of colophonic acids are dissolved in 60 grams of butyl glycol, and are then poured into 500 $cm^3$ of water containing 0.14 mole of ammonium hydroxide. Then, a 0.4% aqueous solution of a polyglycol is added in sufficient quantity to yield one liter of a clear, orangish aqueous solution, the flash point of which is greater than 80° C.

The release composition is applied in any known way, e.g., by a brush, by wiping with a cloth or by spraying, on any non-slippery surface of the mold, whether iron, wood, or concrete. After approximately one hour of drying, the concrete can be cast. After setting and unmolding, the surfaces of the molded concrete pieces have no blemishes nor does the concrete turn to powder during the setting process.

While the invention has been described in detail with reference to preferred embodiments thereof, it will be understood by those skilled in the art that the release composition described herein may be formulated from any combination of the optional components disclosed, or their equivalents. The release composition may be used in facilitating unmolding of any hydraulic bonding material, whether or not presently known, and in all manner of methods for casting molded pre-formed articles from hydraulic bonding material. All such formulations and uses of the release composition of this invention are within the scope and coverage of the following claims.

We claim:

1. A release composition for facilitating the unmolding of hydraulic bonding material such as concrete from molds by being coated on the contact surfaces of said molds before said bonding material is placed in said molds; said release composition comprising the combination of the following elements:

(a) at least one active release agent selected from the group consisting of ammonium salts of organic acids;
(b) at least one clarifying, anti-freeze agent selected from the group consisting of hydroxyethyl ethers of the general formula $R(OCH_2CH_2)n\ OH$, where R is selected from the group consisting of linear and branched aliphatic radicals having from 1 to 6 carbon atoms, and n is a number between 1 and 3;
(c) at least one spreading agent selected from the group consisting of esters, fatty ethoxy alcohols, and low molecular weight cellulosic derivatives;
(d) at least one lubricating agent selected from the group consisting of water-soluble polymers; and
(e) a solvent medium comprising water.

2. The release composition according to claim 1 wherein said active release agent is a salt of a carboxylic acid containing no more than one hydroxyl function per molecule.

3. The release composition according to claim 2 wherein said carboxylic acid has the structure RCOOH, wherein R is selected from the group consisting of alkyl, cycloalkyl, akenyl, cycloalkenyl, and aryl radicals having at least five carbon atoms.

4. The release composition according to claim 3 wherein R is a radical comprising 10 to 30 carbon atoms.

5. The release composition according to claim 4 wherein said carboxylic acid is selected from the group consisting of decanoic acid, naphthenic acid, neodecanoic acid, abietic acid, dodecanoic acid, myristic acid, oleic acid, palmitic acid, and a colophonic acid.

6. The release composition according to claim 3 wherein said carboxylic acid is selected from the group consisting of hexanoic acid, decanoic acid, cyclohexylic acid, naphthenic acid, neodecanoic acid, abietic acid, dodecanoic acid, myristic acid, caprylic acid, oleic acid, palmitic acid, pelargonic acid, undecylic acid, Versatic acid, cyclohexadienic acid, and a colophonic acid.

7. The release composition according to claim 1 wherein said clarifying anti-freeze agent is selected from the group consisting of hydroxyethyl ether, ethyltriethylene glycol, hexyl-diethylene glycol and butyl glycol.

8. The release composition according to claim 7 wherein said clarifying anti-freeze agent is hydroxyethyl ether.

9. The release composition according to claim 7 wherein said clarifying anti-freeze agent is ethyltriethylene glycol.

10. The release composition according to claim 7 wherein said clarifying anti-freeze agent is hexyldiethylene glycol.

11. The release composition according to claim 7 wherein said clarifying anti-freeze agent is butyl glycol.

12. The release composition according to claim 1 wherein said spreading agent is an ester derived from a polyol.

13. The release composition according to claim 1 wherein said ester is the product of the partial esterification of a polyol by a carboxylic acid selected from the group consisting of monobasic and dibasic carboxylic acids, the free hydroxyl groups of said partial ester being ethoxylated.

14. The release composition according to claim 12 or 13 wherein said polyol is selected from the group consisting of glycerin, trimethylolpropane, and pentaerythritol.

15. The release composition according to claim 14 wherein said polyol is glycerin.

16. The release composition according to claim 14 wherein said polyol is trimethylolpropane.

17. The release composition according to claim 14 wherein said polyol is pentaerythritol.

18. The release composition according to claim 1 wherein a sequestering agent is added to said water solvent medium.

19. The release composition according to claim 18 wherein said sequestering agent is selected from the group consisting of ethylenediaminetetraacetic acid and nitrilotriacetic acid.

20. The release composition according to claim 19 wherein said sequestering agent is ethylendiaminetetraacetic acid.

21. The release composition according to claim 19 wherein said sequestering agent is nitrilotriacetic acid.

22. The release composition according to claim 1 wherein said spreading agent is a fatty ethoxyl alcohol.

23. The release composition according to claim 1 wherein said spreading agent is a low molecular weight cellulosic derivative.

24. The release composition according to claim 1 wherein said lubricating agent is selected from the group consisting of polyglycols having a very long chain and linear polysaccharides.

25. A method for facilitating the unmolding of a hydraulic bonding material from a mold, comprising, prior to casting said hydraulic bonding material in said mold, the steps of:

(a) coating the molding surfaces of said mold with the release composition of claim 1; and (b) permitting said release composition to dry.

26. The method according to claim 25 wherein said hydraulic bonding material is concrete.

27. The method according to claim 25 wherein said release composition is coated onto the surface of said mold by means of a brush.

28. The method according to claim 25 wherein said release composition is coated onto the surface of said mold by wiping said surface with a cloth soaked with said composition.

29. The method according to claim 25 wherein said release composition is sprayed onto the surface of said mold.

30. A method for facilitating the unmolding of a hydraulic bonding material from a mold, comprising, prior to casting said hydraulic bonding material in said mold, the steps of:

(a) coating the molding surfaces of said mold with a release composition according to claim 14; and (b) permitting said release composition to dry.

31. The method according to claim 30 wherein said hydraulic bonding material is concrete.

32. A method for facilitating the unmolding of a hydraulic bonding material from a mold, comprising, prior to casting said hydraulic bonding material in said mold, the steps of:

(a) coating the molding surfaces of said mold with a release composition according to claim 15; and (b) permitting said release composition to dry.

33. The method according to claim 32 wherein said hydraulic bonding material is concrete.

34. A method for facilitating the unmolding of a hydraulic bonding material from a mold, comprising, prior to casting said hydraulic bonding material in said mold, the steps of:

(a) coating the molding surfaces of said mold with a release composition according to claim 16; and (b) permitting said release composition to dry.

35. The method according to claim 34 wherein said hydraulic bonding material is concrete.

36. A method for facilitating the unmolding of a hydraulic bonding material from a mold, comprising, prior to casting said hydraulic bonding material in said mold, the steps of:

(a) coating the molding surfaces of said mold with a release composition according to claim 17; and (b) permitting said release composition to dry.

37. The method according to claim 36 wherein said hydraulic bonding composition is concrete.

38. A method of making a molded, pre-formed article comprising the steps of:

(a) casting a hydraulic bonding material in a mold treated in accordance with claim 25;

(b) permitting said hydraulic bonding material to set; and (c) removing the set hydraulic bonding material from said mold.

39. The method according to claim 38 wherein said hydraulic bonding material is concrete.

40. The method according to claim 39 wherein said mold is comprised of iron.

41. The method according to claim 39 wherein said mold is comprised of wood.

42. The method according to claim 39 wherein said mold is comprised of concrete.

* * * * *